US011846093B2

(12) United States Patent
Pasquesi

(10) Patent No.: US 11,846,093 B2
(45) Date of Patent: Dec. 19, 2023

(54) WATERLESS FLOOR DRAIN TRAP VALVE

(71) Applicant: Joe Pasquesi, Highland Park, IL (US)

(72) Inventor: Joe Pasquesi, Highland Park, IL (US)

(73) Assignee: Joe Pasquesi, Highland Park, IL (US)

( * ) Notice: Subject to any disclaimer, the term of this patent is extended or adjusted under 35 U.S.C. 154(b) by 255 days.

(21) Appl. No.: 17/475,695

(22) Filed: Sep. 15, 2021

(65) Prior Publication Data

US 2022/0081883 A1 Mar. 17, 2022

Related U.S. Application Data

(60) Provisional application No. 63/078,568, filed on Sep. 15, 2020.

(51) Int. Cl.
*E03B 7/07* (2006.01)
*E03F 5/04* (2006.01)

(52) U.S. Cl.
CPC ..... *E03B 7/077* (2013.01); *E03F 5/0407* (2013.01)

(58) Field of Classification Search
CPC ..... E03B 7/077; E03F 5/0407
USPC ..... 4/287, 286, 288, 289, 290, 291, 292
See application file for complete search history.

(56) References Cited

U.S. PATENT DOCUMENTS

| | | | |
|---|---|---|---|
| 1,824,924 | A | 9/1931 | Paul et al. |
| 1,910,768 | A | 5/1933 | Hotchkiss, Jr. |
| 1,982,402 | A | 11/1934 | Shade |
| 2,973,537 | A | 3/1961 | Simpson |
| 3,007,484 | A | 11/1961 | Hallinan |
| 3,283,353 | A | 11/1966 | Kirk |
| 3,542,057 | A | 11/1970 | Staiano |
| 4,364,140 | A | 12/1982 | Irwin |
| 4,692,957 | A | 9/1987 | Kovacs |
| 4,974,280 | A | 12/1990 | Ward |
| 6,615,440 | B1 | 9/2003 | Williams |
| 6,626,201 | B1 | 9/2003 | Kim |
| 6,719,004 | B2 | 4/2004 | Huber et al. |
| 9,556,964 | B2 | 1/2017 | Fima |

(Continued)

FOREIGN PATENT DOCUMENTS

| | | |
|---|---|---|
| CN | 102535632 | 7/2012 |
| CN | 103603419 | 2/2014 |

(Continued)

OTHER PUBLICATIONS https://www.restaurantsupply.com/bar-maid-fb-ts20; Bar Maid FB-TS20 Fly-Bye Floor Drain Trap Seal for 2-Inch Drains, Restaurant Supply.com, 3 pages.

(Continued)

*Primary Examiner* — Lori L Baker
(74) *Attorney, Agent, or Firm* — Vedder Price P.C.

(57) ABSTRACT

A Waterless Floor Drain Trap Valve is provided as a drain line backup to withstand the pressure from water/sewage reversing direction and flowing into the occupied space of the building. During usage, as a nut on the top of the Valve is tightened, the expandable outer seal forms a plurality of seal points within the inside diameter of the floor drainpipe while almost simultaneously the bottom cover travels in an upward direction further compressing the expandable outer seal and providing robust sealing to prevent backflow into the living space. The Waterless Floor Drain Trap Valve is further configured to connect remotely to various diagnostic devices, mobile platforms and applications for real-time monitoring of the valve performance.

20 Claims, 6 Drawing Sheets

(56) References Cited

U.S. PATENT DOCUMENTS

| | | | |
|---|---|---|---|
| 2007/0089254 | A1 | 4/2007 | Alaine |
| 2007/0215212 | A1 | 9/2007 | Demeniuk |
| 2008/0083058 | A1 | 4/2008 | Heffner |
| 2008/0244816 | A1 | 10/2008 | Babb et al. |
| 2016/0319532 | A1 | 11/2016 | Fima |
| 2016/0325320 | A1 | 11/2016 | Oberto et al. |
| 2017/0232484 | A1 | 8/2017 | Kehoe et al. |

FOREIGN PATENT DOCUMENTS

| | | | |
|---|---|---|---|
| CN | 105839770 | A | 8/2016 |
| CN | 106480965 | | 3/2017 |
| CN | 106499036 | | 3/2017 |
| CN | 106703163 | | 5/2017 |
| KR | 101121930 | | 4/2012 |
| KR | 20130045791 | | 5/2013 |
| KR | 101273417 | | 6/2013 |
| KR | 200473414 | | 8/2014 |
| KR | 101621682 | | 5/2016 |
| WO | 2002095150 | A2 | 11/2002 |
| WO | 2013079799 | A1 | 6/2013 |
| WO | 2015152472 | | 10/2015 |

OTHER PUBLICATIONS https://rectorseal.com/product/sureseal/; SureSeal Waterless Inline Drain Trap Seal—RectorSeal; Sep. 15, 2021; 1 page.

https://www.masterbuildermercantile.com/products/mifab-mi-gard-6-floor-drain-trap-seal-for-6-pipe-size; MIFAB MI-GARD-6 Floor Drain Trap Seal for 6" Pipe Size; Sep. 15, 2021; 1 pg.

https://www.menards.com/main/plumbing/pipe-fittings/flexible-fittings/ab-a-3-trap-tite-floor-drain-trap/69451/p-1564727276844.htm; AB&A Trap Tite Floor Drain Trap at Menards; Sep. 15, 2021; 1 pg.

https://kofflersales.com/p/green-drain-flow-trap.asp?itemid=84696&gclid=EAlalQobChMI7LP8tl6F6wIVCNbACh0abAYYEAQYASABEgI84_D_BWE; Green Drain One Way Flow Trap and Enzyme Cleaner; Sep. 15, 2021; 1 pg.

https://www.homedepot.com/p/Oatey-3-in-Drain-Trap-Seal-437422/3096702627; Oatey 3 in. Drain Trap Seal-437422—The Home Depot; Sep. 15, 2021; 3 pgs.

Zoro Guide Hose, Polyethylene Plastic; Zoro # G3127241; 3 pgs.

VALVE IN CLOSED POSITION

VALVE IN CLOSED POSITION

VALVE IN OPEN POSITION

VALVE IN CLOSED POSITION

WATERLESS FLOOR DRAIN TRAP VALVE

This application claims the benefit of and priority to U.S. Provisional Application No. 63/078,568, filed Sep. 15, 2020, the content of which is hereby incorporated by reference.

BACKGROUND

Field of the Invention

The present invention generally relates to an improved Waterless Floor Drain Trap Valve for addressing common issues related to open floor drains and existing waterless trap valves. More particularly, the present invention is directed to a waterless floor drain trap valve with smart and improved sealing functionality that permits the flow of fluid within a pipe in one direction but prevents the flow (e.g., fumes, sewer odors and other fluids) in the reverse direction.

Background

The current market for floor drainage provides a variety of options and selections for conventional open floor drains and valves. Typically, a draining system is installed in an open floor or sewer designed to easily displace sewage like waste water, dirty water, rain water, etc. and preventing the sewage and offensive odor from flowing backward (in the reverse direction). Most drain and plumbing fixtures have traditionally provided a means of drainage for open floors using waterless trap valves. However, when it comes to utilizing such products for efficient backflow prevention or the entrance or prevent the escape of sewer odors, there is a dearth of such waterless floor drain trap valves.

In some instances, valve traps of specific shapes and configurations have been used to prevent backflow of harmful or undesirable sewer or pipe odors/gases into buildings while permitting drainage of unwanted fluid from floors and other horizontal surfaces. Standard commercial off-the-shelf open floor drains as well as existing waterless trap valves commonly have a housing installed on a drainpipe with a support ring attached to the housing to communicate with the sewer. However, such conventional open floor drains might not necessarily function effectively to prevent the flow of obnoxious sewer gases through the drain. In addition, sometimes conventional drains are relatively difficult and expensive to install. The scarcity of effective options is more prevalent when it comes to the market for waterless floor drain trap valves.

A waterless drain trap is generally designed to function as a normal floor drain and must allow the free flow of water into it and the building drain line. Current designs of waterless traps are unable to perform such functions with the necessary efficiency desired in plumbing work. The very design of a conventional waterless trap might be actually detrimental to backflow prevention. For example, in the event of a drain line backup conventional trap valves are not built strong enough to withstand the heavy pressure from water/sewage reversing direction and flowing into the occupied space of the building. Such reverse flows can be caused by various conditions—e.g., blocked main, collapsed drain line or heavy rains causing municipal sewers to backflow in certain situations.

Finally, the open floor drains and existing waterless trap valves fail to prevent the entrance of sewer odors, insects and other unwanted house guests. The escape of sewer odors is a common occurrence in currently available conventional trap valves when the water in a "P" trap evaporates allowing odors to escape into the living space. Generally, the "P" traps must be periodically refilled with water to prevent drying out. For example, such phenomena occur naturally each time a sink drain has water running from the faucet. Floor drains on the other hand are not always used in this fashion so they have a tendency to dry out between uses. Further worsening the issue is the entrance of offensive sewer odors making it unhealthy for individuals to be present in the vicinity of the valves.

The present invention is directed to a novel Waterless Floor Drain Trap Valve with smart and improved sealing functionality that solves the foregoing common issues in the field of open floor drains and trap valves.

SUMMARY

Embodiments disclosed in the present invention provide a novel and improved Waterless Floor Drain Trap Valve that may be used for various purposes.

A Waterless Floor Drain Trap Valve is provided comprising an inlet end with a recessed opening comprising a grate (or disk) to direct fluid flow and capable of allowing fluid into the valve, wherein the edge along the top surface of the grate (or disk) is flushed with the top surface of the inlet end. The Waterless Floor Drain Trap Valve comprises a top cover, an opposite outlet end with a bottom cover and a silicone gasket/skirt functioning as an expandable outer seal positioned between the top and bottom cover. The smart Valve includes a first sensor and a second sensor disposed within the Valve and configured to deliver real-time monitoring and backflow management system for a variety of situations. The sensors are further adapted and configured to connect remotely and wirelessly transmit data to various diagnostic devices, mobile platforms and applications for smart and improved monitoring of the valve performance.

The Waterless Floor Drain Trap Valve further comprises a conventional fastener (e.g., nut, wingnut or butterfly nut) positioned proximate to the top cover, a threaded rod connected to a backflow preventer plate, a backflow plate spring (for the backflow preventer plate) along with a backflow preventer seal for sealing the backflow preventer plate. During normal operation of the Valve, the backflow preventer plate spring acts on the backflow preventer plate to keep it in the upward sealed position and the backflow preventer seal along with the expandable outer seal blocks the flow of sewage in the reverse direction. The backflow preventer plate can be made of steel or any equivalent material with similar strength and tensile characteristics to withstand backflow pressure common in floor drains.

During usage of the Valve in a closed/open position, the various elements of the Valve function cooperatively to provide a one-way valve allowing water to flow down the drain while preventing odors, harmful gases, pathogens or insects from entering the living space. The improved Valve along with its attached expandable outer seal prevents the entry of drain flies, roaches, rodents and other unwanted pests from the floor drain into the living space—while still allowing the Valve to function as a drain. During usage, as the nut on the top of the Valve is tightened, the expandable outer seal forms a plurality of seal points within the inside diameter of the floor drainpipe while almost simultaneously the bottom cover travels in an upward direction further compressing the expandable outer seal and providing robust sealing to prevent backflow into the living space.

An improved Waterless Floor Drain Trap Valve is further provided to act as a drain line backup to withstand the pressure from water/sewage reversing direction and flowing into the occupied space of the building. In the event of a drain line backup, the backflow preventer seal resting on the backflow preventer plate seals off and blocks the flow of sewage in the reverse direction.

The uniquely configured backflow preventer plate and the backflow preventer seal—positioned in proximity to the bottom cover of the outlet end—function cooperatively with each other to secure the Valve as a one-way valve allowing water to flow down the drain while preventing odors, harmful gases, pathogens or insects from entering the living space. In the event of a drain line backup, the backflow plate spring acts with sufficient force on the backflow preventer plate to keep it in the upward sealed position while the force of the spring is further balanced with the weight of the backflow preventer plate so as not to obstruct the passage of water in the normal flow direction. During usage, reasonable care should be taken to ensure that the water provides sufficient weight to compress the spring allowing the backflow preventer plate to open and allow water to flow to the drain.

The design and the unique configuration and positioning of the backflow preventer plate and the backflow plate spring along with the backflow preventer seal are some of the key innovative elements of the improved Valve. To achieve optimum sealing once the expandable outer seal forms a plurality of seal points within the inside diameter of the floor drainpipe, further tightening of the nut allows the backflow plate spring to exert a light upward force on the backflow plate such that the backflow preventer seal needs only a small amount of pressure to function as a one-way Valve. Further, the resiliently rigid expandable outer seal of the improved Valve is configured to seal against the inner surface of a drain and prevents backflow of gases through the Valve structure. The flexibility in the design and configuration of the various elements of the Waterless Floor Drain Trap Valve (e.g., the elastic memory of the expandable outer seal urging the peripheral edge of the expandable outer seal to extend horizontally and form seal points against the inner surface of the drain, the backflow plate spring, backflow preventer plate and balancing of the spring force with the weight of the backflow preventer plate) provides optimum sealing and performance when the Valve is used for normal operations.

An improved and smart Waterless Floor Drain Trap Valve is further configured to connect remotely to various diagnostic devices, mobile platforms and applications for real-time monitoring of the valve performance. The smart Valve comprises a first sensor and a second sensor disposed within the Valve and configured to deliver an improved backflow management system for consumers. The first and second sensors are positioned in proximity to the inlet and outlet ends and are attached to the top cover and the bottom cover of the Valve, respectively. During usage of the Valve, the first sensor is configured to sense/receive information indicative of the flow of water into the grate in one direction and the second sensor is configured to sense/receive information indicative of fluid, sewage and/or gases flowing in the reverse direction (e.g., drain line backup flow) and thereby provide advance warning to prevent backflow and escape of odors into the living area.

The first and second sensors are further adapted and configured to remotely connect and wirelessly transmit data associated with flow of fluid and/or gases to computer-based diagnostic devices or mobile applications through Wi-Fi or existing cellular networks for enhanced reliability and closed-loop feedback control of the Waterless Floor Drain Trap Valve. For example, in the event of a potential drain line backup, when the second sensor receives information indicative of fluid or gases flowing in the reverse direction into the living space, the second sensor can wirelessly transmit the data associated with such flow to any bluetooth-enabled device (e.g., smartphone, tablet or computer) of a consumer and thereby provide advance real-time warning to the consumer.

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

BRIEF DESCRIPTION OF THE DRAWINGS

Certain embodiments are shown in the drawings. However, it is understood that the present disclosure is not limited to the arrangements and instrumentality shown in the attached drawings.

DETAILED DESCRIPTION OF THE INVENTION

Figure 1:
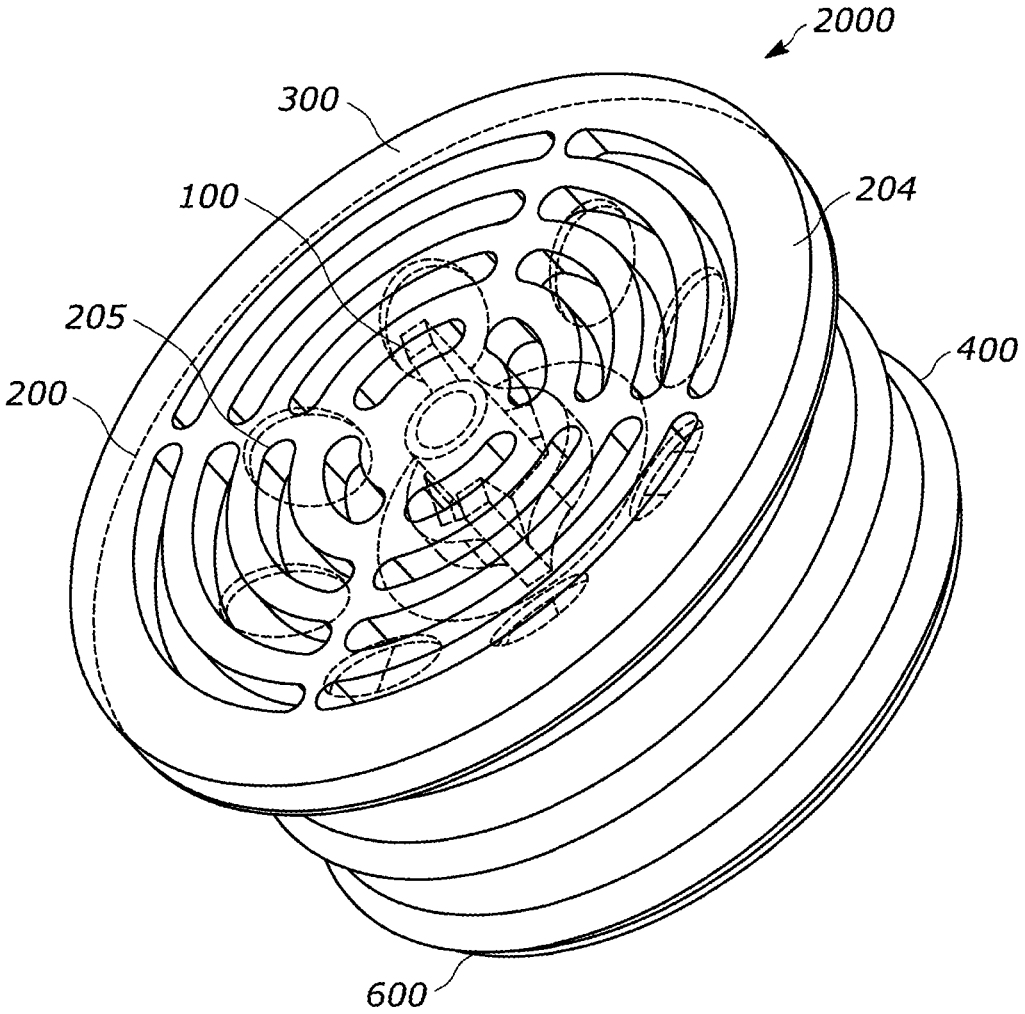
FIG. 1 is a top perspective view of an embodiment of a Waterless Floor Drain Trap Valve.

For the purposes of promoting and understanding the principles disclosed herein, reference is now made to the preferred embodiments illustrated in the drawings, and specific language is used to describe the same.

It is understood that no limitation of the scope of the invention is hereby intended. Such alterations and further modifications in the illustrated apparatus and such further applications of the principles disclosed and illustrated herein are contemplated as would normally occur to one of ordinary skill in the art to which this invention relates.

In an embodiment, a Waterless Floor Drain Trap Valve comprises pre-configured elements designed to work in tandem to provide improved Valve functionality and sealing with the utmost efficiency. In the depicted embodiment, the Waterless Floor Drain Trap Valve comprises a substantially cylindrical body having an inlet end with a recessed opening comprising a grate (or disk) to direct water flow, wherein the edge along the top surface of the grate (or disk) is flushed with the top surface of the inlet end. The Waterless Floor Drain Trap Valve further comprises a top cover and an opposite outlet end with a bottom cover. In the depicted embodiment, the top and bottom cover further comprise a centrally located aperture and a plurality of apertures circumferentially dispersed at a predetermined distance from each other.

The improved Valve further includes a silicone gasket/skirt functioning as an expandable outer seal positioned between the inlet top cover and the opposite outlet bottom cover, a conventional fastener (e.g., nut, wingnut or butterfly nut) positioned proximate to the top cover, a threaded rod connected to a backflow preventer plate, a backflow plate spring (for the backflow preventer plate) along with a backflow preventer seal for sealing the backflow preventer plate—all elements designed and configured to work cooperatively to achieve high-performance sealing capability for drain traps.

In the depicted embodiment, the Valve is configured to allow normal water flow to pass through the cylindrical body of the Valve when the Valve is used as a floor drain trap valve. During the normal usage of the Valve, the relatively rigid expandable outer seal mounted to the Valve body further comprises outwardly expandable resilient seal points positioned within the cylindrical body such that during usage of the Valve in a drainpipe, the seal points on a portion of the circumferential edge of the Valve are tightly compressed against the inner surface of a floor drainpipe to provide optimum sealing.

In another embodiment, the Waterless Floor Drain Trap Valve comprises an inlet end with a recessed opening comprising a grate (or disk) to direct water flow, wherein the edge along the top surface of the grate (or disk) is flushed with the top surface of the inlet end. The Valve further comprises a top cover and an opposed outlet end with a bottom cover, an expandable outer seal positioned between the top and bottom cover, a nut positioned proximate to the top cover, a threaded rod, a backflow plate spring and a backflow preventer plate along with a backflow preventer seal. During the usage of the Valve in the closed position, the resiliently rigid expandable outer seal is configured to seal against the inner surface of a drain and prevent backflow of gases through the Valve structure. The flexibility in the design and configuration of the various elements of the Waterless Floor Drain Trap Valve (e.g., the elastic memory of the expandable outer seal urging the peripheral edge of the expandable outer seal to extend horizontally and form seal points against the inner surface of the drain, the backflow plate spring, backflow preventer plate and balancing of the spring force with the weight of the backflow preventer plate) provides optimum sealing and performance.

In another embodiment, a Waterless Floor Drain Trap Valve is further configured to connect remotely to various diagnostic devices and applications via a first sensor and a second sensor disposed within the Valve and configured to deliver real-time monitoring and an improved backflow management system for a variety of situations. The first and second sensors are positioned in proximity to the inlet and outlet ends and are attached to the top cover and the bottom cover of the Valve, respectively. During usage of the Valve, the first sensor is configured to sense the flow of water into the grate and the second sensor is configured to receive information indicative of fluid, sewage and/or gases flowing in the reverse direction (e.g., drain line backup flow) and thereby prevent backflow and escape of odors into the living area. The sensors are further adapted and configured to remotely connect and wirelessly transmit data associated with flow of fluid and/or gases to computer-based diagnostic devices or mobile applications through Wi-Fi or existing cellular networks for enhanced reliability and closed-loop feedback control of the Waterless Floor Drain Trap Valve.

In the depicted embodiment, the backflow preventer plate and the backflow preventer seal are positioned in proximity to the bottom cover of the outlet end and are configured such that the upper peripheral edge of the backflow preventer plate is configured to move in an upward direction to form a sealing contact with a downwardly facing sealing surface of a backflow preventer seal when the nut on the Valve is tightened during usage to generate a seal on the inside of a drainpipe.

In another embodiment, a Waterless Floor Drain Trap Valve is positioned between the inlet and outlet of a drain basin. In the depicted embodiment, the Valve is configured to prevent backflow and escape of odors while still allowing the Valve to function as a drain. The seal on the inside diameter of the drainpipe is achieved by rotating and tightening the nut by a certain predetermined amount over the top cover on the inlet end of the Valve. The rotating and tightening of the nut in proximity to the inlet top cover of the inlet end causes the opposite outlet end bottom cover to travel a certain predetermined distance in an upward direction thereby compressing the expandable outer seal and expanding it outward to form a tight seal on the inside of the drainpipe. This improved configuration and functionality of the various elements of the Waterless Floor Drain Trap Valve provides effective sealing and prevention of backflow into the living space.

In another embodiment, a Waterless Floor Drain Trap Valve is provided as a drain line backup to withstand the pressure from water/sewage reversing direction and flowing into the occupied space of the building. In the depicted embodiment, the Waterless Floor Drain Trap Valve comprises a grate, an inlet top cover and an outlet bottom cover, a silicone gasket/skirt functioning as an expandable outer seal positioned between the top and bottom cover along with a conventional fastener (e.g., nut, wingnut or butterfly nut) positioned proximate to the top cover, a backflow preventer plate attached to a threaded rod, a backflow plate spring and a backflow preventer seal positioned in proximity to the outlet bottom cover. In the event of a drain line backup, the backflow preventer plate in cooperation with the backflow preventer seal blocks the flow of sewage in the reverse direction.

The backflow plate is made of steel or a suitably strong material to withstand any backflow pressure as is common in floor drains. One of the key aspects of this invention is the unique configuration of the backflow preventer plate along with the positioning of the backflow preventer seal in proximity to the bottom cover in order for the Valve to withstand the pressure from water/sewage reversing direction and prevent flowing into the occupied space of the building.

In another embodiment, a Waterless Floor Drain Trap Valve is provided in an open position. In the depicted embodiment, the Waterless Floor Drain Trap Valve comprises an inlet end with a recessed opening comprising a grate (or disk) to direct water flow, wherein the edge along the top surface of the grate (or disk) is flushed with the top surface of the inlet end, a top cover and an opposite bottom cover, a silicone gasket/skirt functioning as an expandable outer seal positioned between the top and bottom cover along with a conventional fastener (e.g., nut, wingnut or butterfly nut) positioned proximate to the top cover and a uniquely configured backflow preventer plate attached to a threaded rod, a backflow plate spring and a backflow preventer seal in proximity to the bottom cover.

The open position in the depicted embodiment is only necessary when the Valve has to act as a normal floor drain allowing the entrance of water into the drain line. During usage of the Valve, the backflow plate spring acts on the backflow preventer plate to keep it in the upward sealed position within the Valve during usage as a one-way Valve. During usage of the Valve, the first sensor is configured to sense the flow of water into the grate and the second sensor is configured to sense/receive information indicative of fluid, sewage and/or gases flowing in the reverse direction (e.g., drain line backup flow) and thereby provide advance warning to prevent backflow and escape of odors into the living area.

The flexibility in the design and configuration of the various elements of the Waterless Floor Drain Trap Valve (e.g., the elastic memory of the expandable outer seal urging the peripheral edge of the expandable outer seal to extend horizontally and form seal points against the inner surface of the drain, the backflow plate spring and the backflow preventer plate and balancing of the spring force with the weight of the backflow preventer plate) provides optimum sealing and performance.

FIG. 1 is a top perspective view of an embodiment of a Waterless Floor Drain Trap Valve. As shown in FIG. 1, an improved Valve 2000 is provided comprising a substantially cylindrical body having an inlet end with a recessed opening comprising a grate (or disk) 300 to direct water flow, wherein the edge along the top surface of the grate (or disk) 300 is flushed with the top surface of the inlet end, a top cover 200 and an opposed outlet end with a bottom cover 600. As illustrated in FIG. 1, in the depicted embodiment, the top cover 200 and bottom cover 600 further comprise a centrally located aperture and a plurality of apertures (205) radially positioned and circumferentially dispersed at a predetermined distance from each other. The improved Valve 2000 further comprises an expandable outer seal 400 positioned between the inlet top cover 200 and the outlet bottom cover 600, and a conventional fastener (e.g., a wingnut) 100 positioned proximate to the inlet top cover 200.

Figure 2:
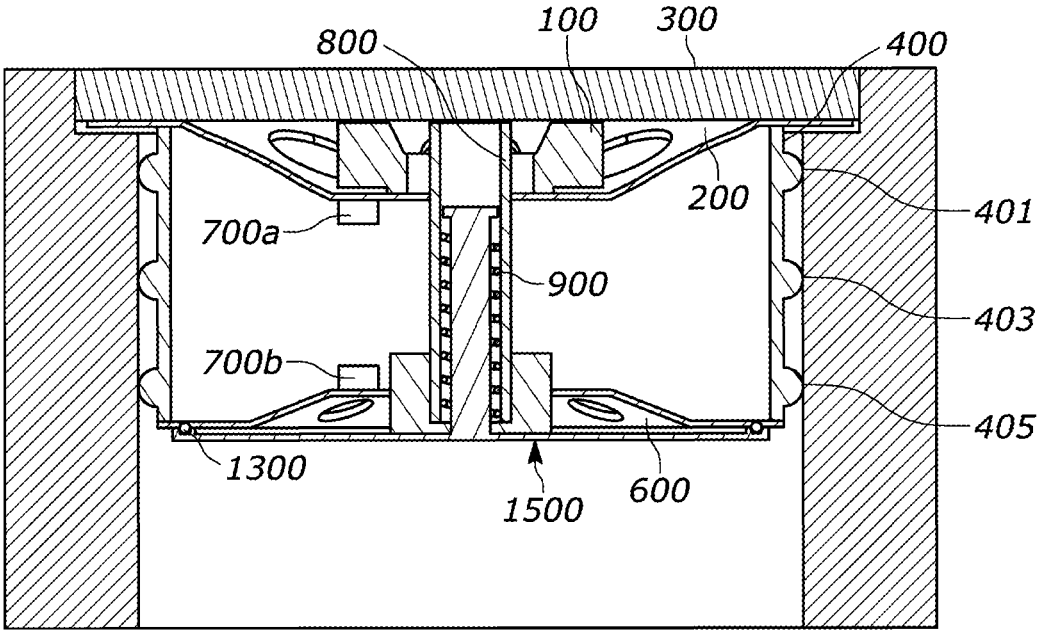
FIGS. 2 and 3 show the cross-section of an embodiment of a Waterless Floor Drain Trap Valve showing the Valve in the closed position during usage.
Figure 3:
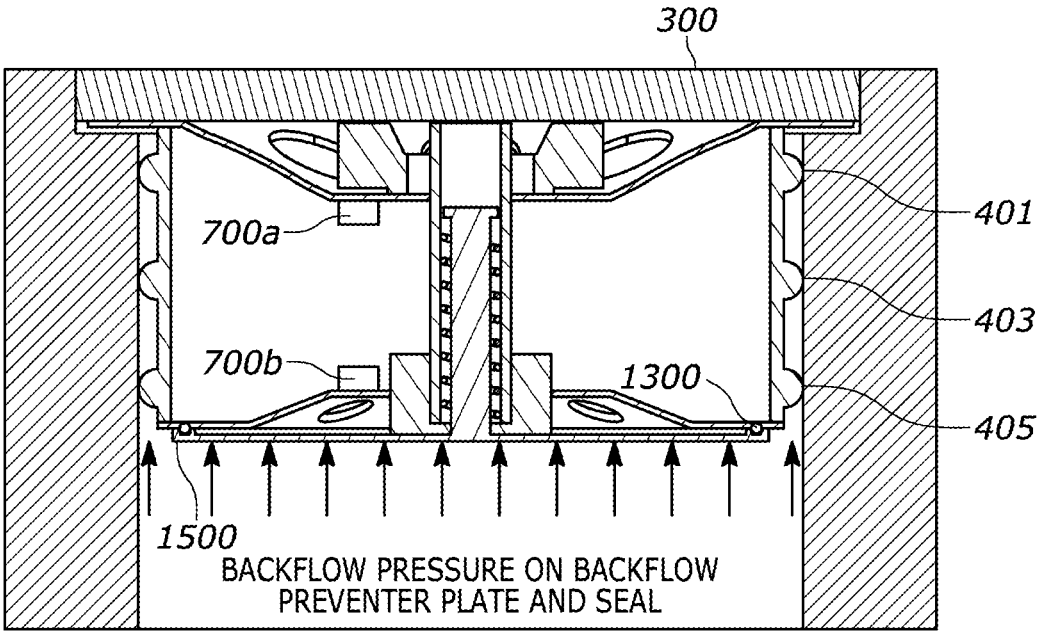

FIGS. 2 and 3 illustrate the cross-section of an embodiment of a Waterless Floor Drain Trap Valve showing the Valve in the closed position during usage. As illustrated in FIGS. 2 and 3, the improved Valve 2000 comprising an inlet end with a recessed opening comprising a grate (or disk) 300 to direct water flow, wherein the edge along the top surface of the grate (or disk) 300 is flushed with the top surface of the inlet end, a top cover 200 and an opposed outlet end with a bottom cover 600, an expandable outer seal 400 positioned between the top cover 200 and bottom cover 400, a nut 100 positioned proximate to the top cover 200, a threaded rod 800 connected to a backflow preventer plate 1500, a backflow plate spring 900 along with a backflow preventer seal 1300 is provided. As illustrated, the Valve further comprises a first sensor 700*a* and a second sensor 700*b* disposed within the Valve 2000 and configured to deliver real-time monitoring and an improved backflow management system for a variety of situations.

As further illustrated in FIGS. 2 and 3, the first sensor 700*a* and the second sensor 700*b* are strategically positioned in proximity to the inlet and outlet ends, wherein the sensors 700*a*, 700*b* are respectively attached to the top cover 200 and the bottom cover 600 of the Valve 2000. During usage of the Valve 2000, the first sensor 700*a* is configured to sense the flow of water into the grate and the second sensor 700*b* is configured to receive information indicative of fluid, sewage and/or gases flowing in the reverse direction (e.g., drain line backup flow) and thereby provide advance warning to prevent backflow and escape of odors into the living area.

The sensors (700*a*, 700*b*) are further adapted and configured to remotely connect and wirelessly transmit data associated with flow of fluid and/or gases to computer-based diagnostic devices or mobile applications through Wi-Fi or existing cellular networks for enhanced reliability and closed-loop feedback control of the Waterless Floor Drain Trap Valve (not shown in the Figure). For example, in the event of a potential drain line backup, when the second sensor 700*b* senses and receives information indicative of fluid or gases/sewage odors flowing in the reverse direction, the second sensor 700*b* can wirelessly transmit the data associated with such flow to any bluetooth-enabled device (e.g., smartphone, tablet, or computer) of a consumer and thereby provide advance real-time warning to the consumer.

As illustrated in the depicted embodiment, during usage of the Valve 2000 in a closed position, the nut 100, top cover 200, bottom cover 600, expandable outer seal 400, threaded rod 800 and backflow plate spring 900 along with the backflow preventer plate 1500 and the backflow preventer seal 1300 function cooperatively and in tandem to secure the Valve 2000 and provide the functionality of a waterless floor drain trap valve. During the usage of the Valve 2000 in the closed position, the resiliently rigid expandable outer seal 400 is configured to seal against the inner surface of a drain and prevents backflow of gases through the Valve structure.

The flexibility in the design and configuration of the various elements of the Waterless Floor Drain Trap Valve 2000 (e.g., the elastic memory of the expandable outer seal 400 urging the peripheral edge of the expandable outer seal to extend horizontally and form seal points (401, 403, 405) against the inner surface of the drain, the backflow plate spring 900, backflow preventer plate 1500 and balancing of the spring force 900 with the weight of the backflow preventer plate 1500) along with the strategically positioned sensors 700*a*, 700*b* provides optimum sealing and performance.

The improved Valve 2000 in this position acts to prevent backflow and escape of odors while still allowing the Valve 2000 to function as a drain. The seal on the inside diameter of the drainpipe is achieved by tightening the nut 100 on top of the Valve 2000 and creating foolproof seal points (401, 403 and 405) against the inner surface of the drain. During usage, the rotating and tightening of the nut 100 in proximity to the inlet top cover 200 of the inlet end causes the opposite outlet end bottom cover 600 to travel a certain predetermined distance in an upward direction thereby compressing the expandable outer seal 400 and expanding it outward to form a tight seal on the inside of the drainpipe (seal points 401, 403 and 405) and effectively prevents any backflow into the living space. As further illustrated in FIG. 3, the backflow preventer plate 1500 is designed to withstand the backflow pressure.

Figure 4:
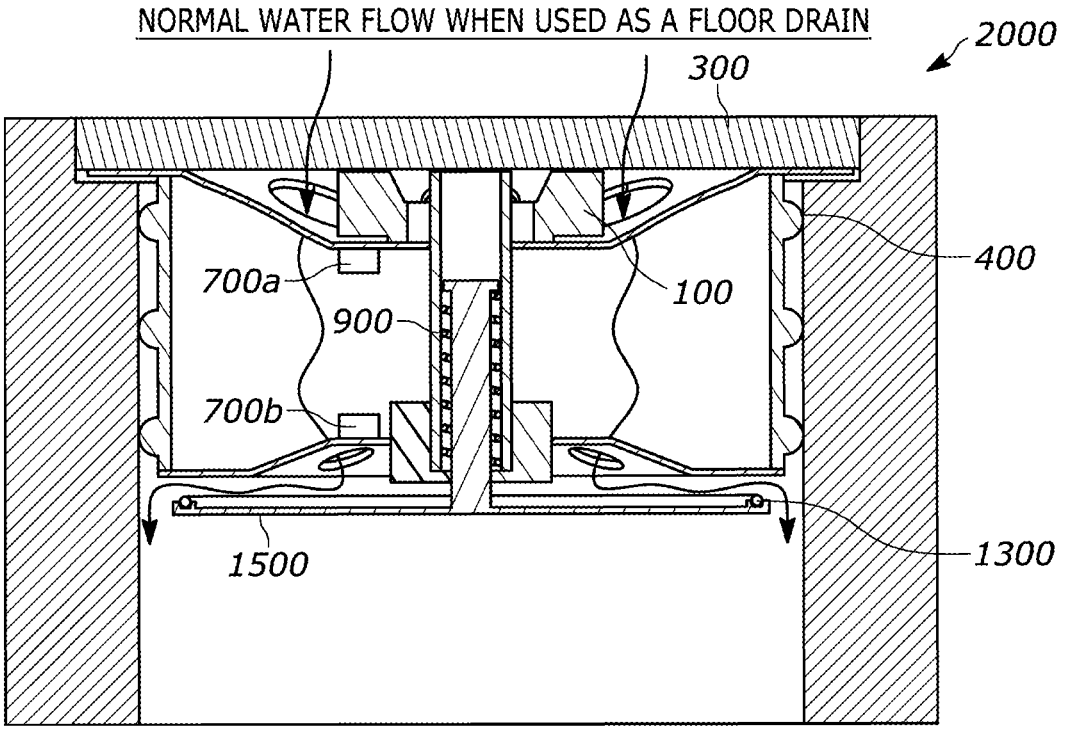
FIG. 4 shows the cross-section of an embodiment of a Waterless Floor Drain Trap Valve showing the Valve in the open position when the Valve is used with normal water flow as a floor drain.

FIG. 4 illustrates the cross-section of an embodiment of a Waterless Floor Drain Trap Valve showing the Valve in the open position during normal water flow when the Valve 2000 is used as a floor drain. As illustrated in FIG. 4, the improved Valve 2000 comprising an inlet end with a recessed opening comprising a grate (or disk) 300 to direct water flow, wherein the edge along the top surface of the grate (or disk) 300 is flushed with the top surface of the inlet end with a top cover 200 and an opposite outlet end with a bottom cover 600, a first sensor 700*a*, a second sensor 700*b*, an expandable outer seal 400 positioned between the top cover 200 and bottom cover 400, a nut 100 positioned proximate to the top cover 200, a threaded rod 800, a backflow plate spring 900, a backflow preventer plate 1500 along with a backflow preventer seal 1300 is provided in an open position.

During the usage of the Valve 2000 in the open position during a normal water flow, the improved Valve 2000 has to act as a normal floor drain allowing the entrance of water into the drain line. The backflow plate spring 900 acts on the backflow preventer plate 1500 to keep it in the upward sealed position. In the depicted embodiment, the spring force generated by the backflow plate spring 900 is balanced with the weight of the backflow preventer plate 1500. As illustrated, the improved Valve 2000 does not hinder the passage of water in the normal flow direction during usage. In order to perform the one-way valve functionality, the weight of the water flowing into the improved Valve 2000 must be sufficient to compress the spring 900 and allow the backflow preventer plate 1500 to open and allow water to flow to the drain.

Figure 5:
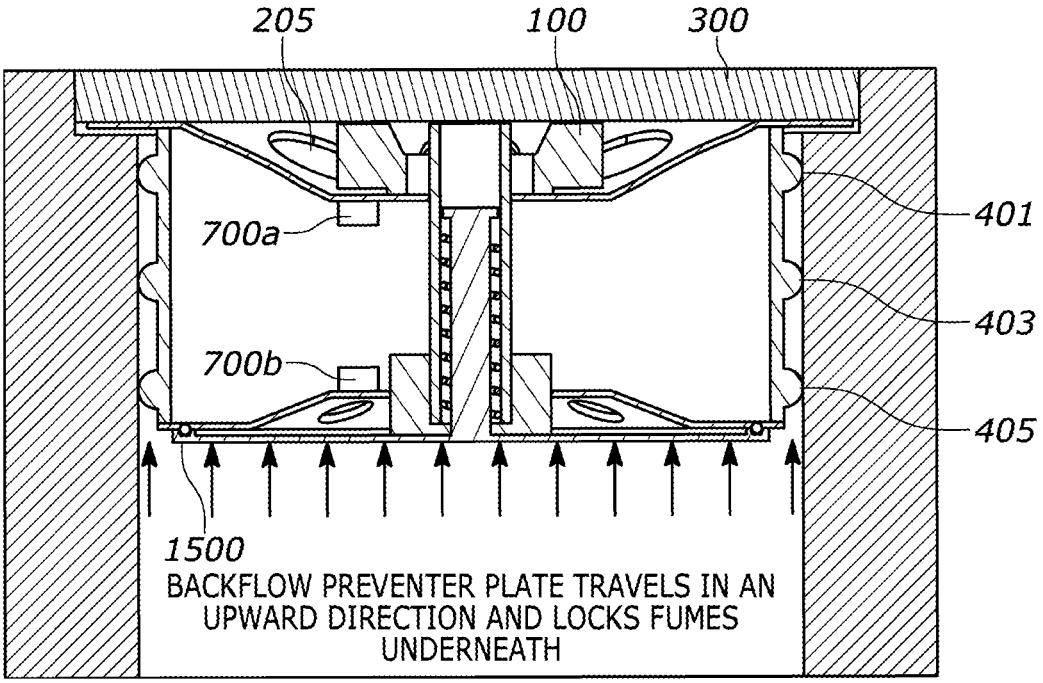
FIG. 5 shows the cross-section of an embodiment of a Waterless Floor Drain Trap Valve showing the Valve in closed position when the Valve is used with normal water flow as a floor drain.

As illustrated in FIG. 5, the cross-section of an embodiment of a Waterless Floor Drain Trap Valve 2000 shows the Valve in the closed position during usage. The functionality of the improved Valve 2000 in this position is the same as in FIG. 3 above. However, in addition to backflow prevention shown in FIG. 3, as illustrated in FIG. 5, the improved Valve 2000 is further capable of separating the function of odor and insect intrusion from the backflow prevention. In the event of a potential drain line backup, when the second sensor 700*b* receives information indicative of fluid or gases flowing in the reverse direction, the second sensor 700*b* can wirelessly transmit the data associated with such flow to any bluetooth-enabled device (e.g., smartphone, tablet or computer) of a consumer and thereby provide advance real-time warning to the consumer (not shown in the Figure). During the usage of the Valve 2000 in the closed position during a normal water flow, the backflow preventer plate 1500, backflow preventer seal 1300 and backflow plate spring 900 are the primary components to prevent the reverse flow or the escape of odors and insects.

As further illustrated, the expandable outer seal 400 is also engaged in this closed position. The flexibility in the design of the Waterless Floor Drain Trap Valve 2000 (e.g., the elastic memory of the expandable outer seal 400) urges the peripheral edge of the expandable outer seal 400 to extend horizontally and form seal points (401, 403 and 405) for optimum sealing against the inner surface of the drain. The improved Valve 2000 acts to prevent backflow and escape of odors while still allowing the Valve 2000 to function as a drain. The seal on the inside diameter of the drainpipe is achieved by tightening the nut 100 on top of the Valve 2000 and creating foolproof seal points (401, 403 and 405) against the inner surface of the drain. During usage, the configuration causes the bottom cover 600 to travel upward thereby compressing the expandable outer seal 400 to form a tight seal on the inside of the drainpipe and effectively preventing any backflow into the living space. It is further noted, the backflow plate spring 900 exerts a light upward force on the backflow plate 1500 and the compliant backflow preventer seal 1300 needs only a small amount of pressure for optimum sealing.

Figure 6:
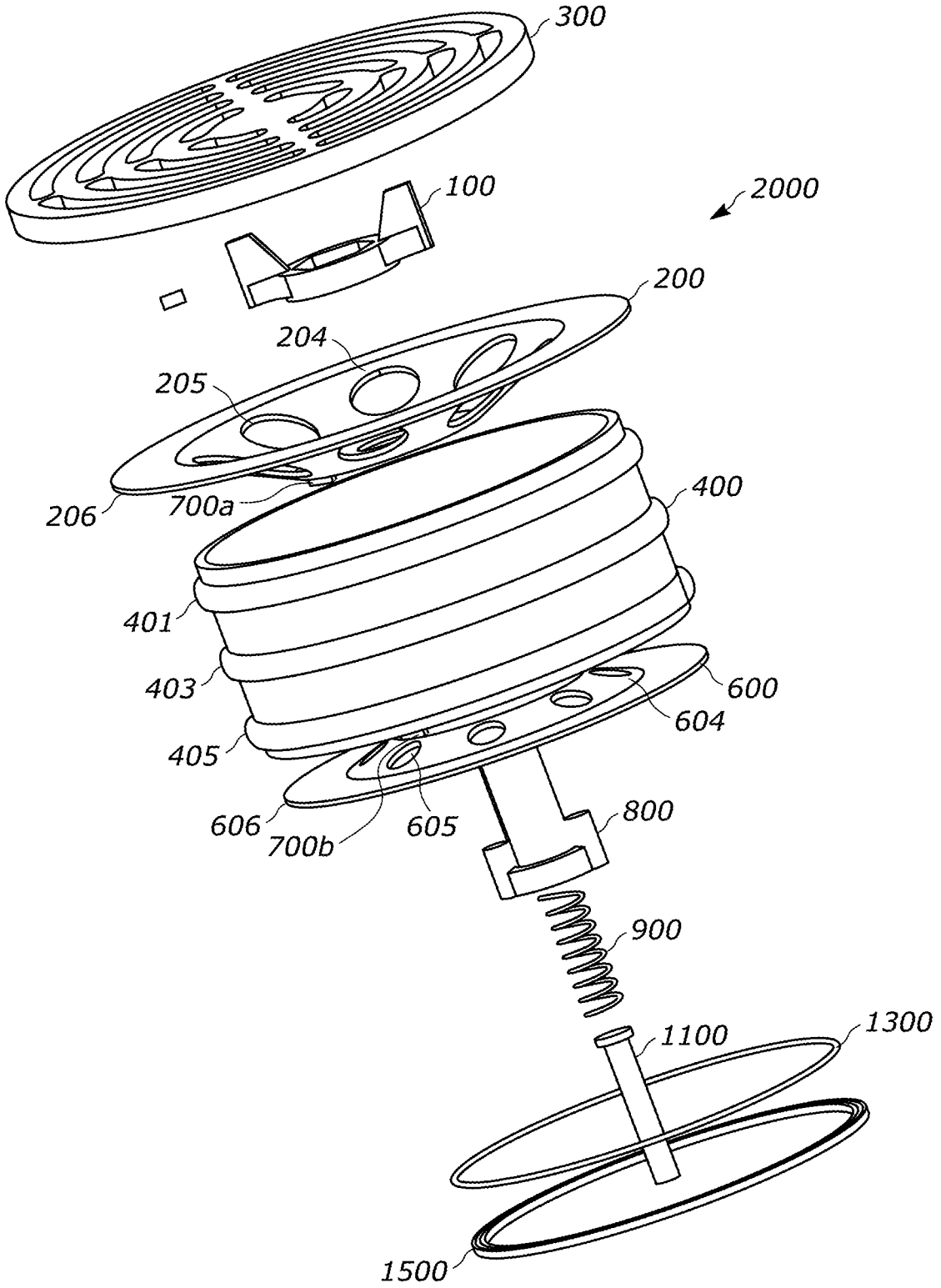
FIG. 6 shows an exploded view of the various elements of an embodiment of a Waterless Floor Drain Trap Valve.
Figure 7:
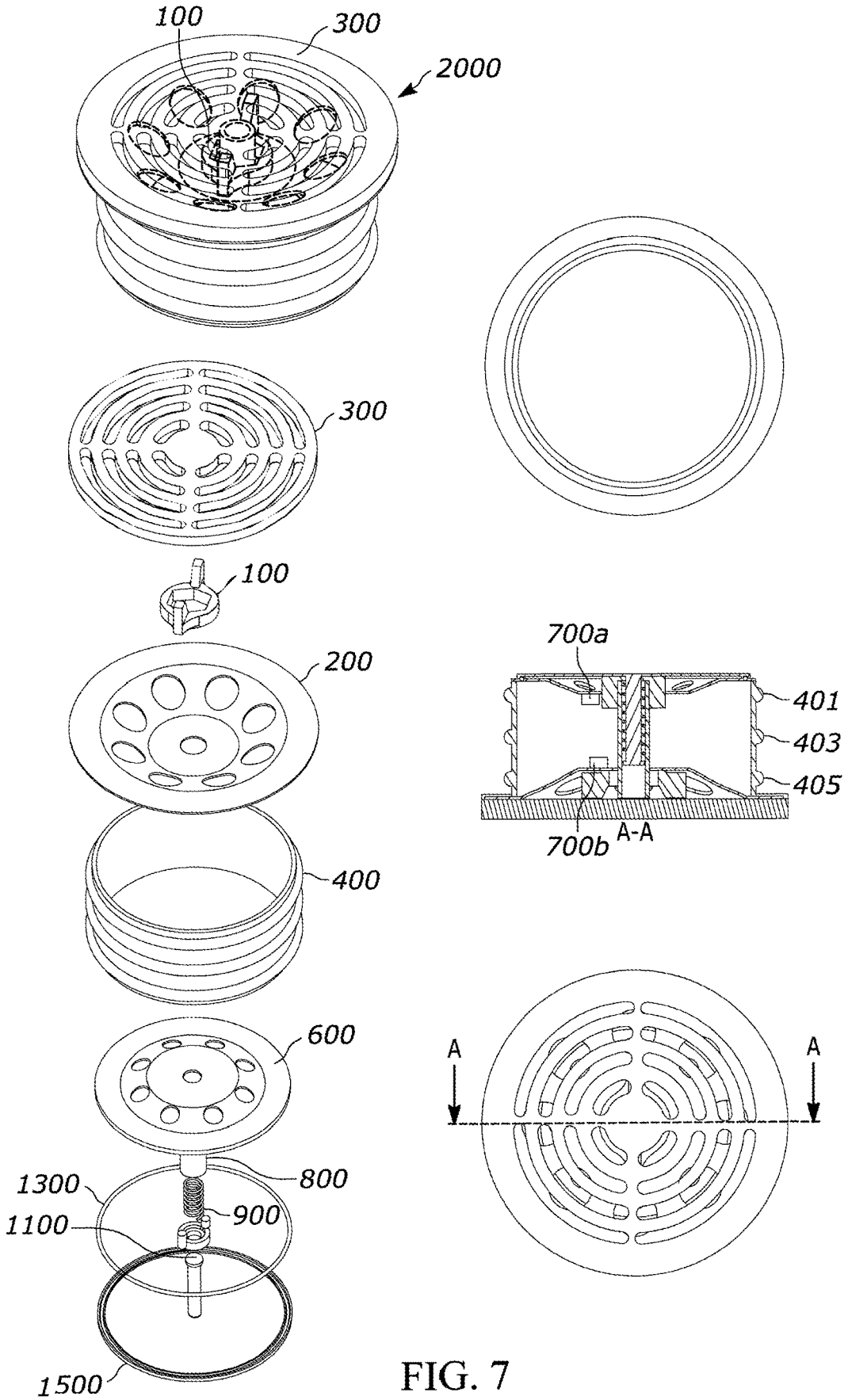
FIG. 7 shows the individual components of an embodiment of a Waterless Floor Drain Trap Valve.
Figure 8:
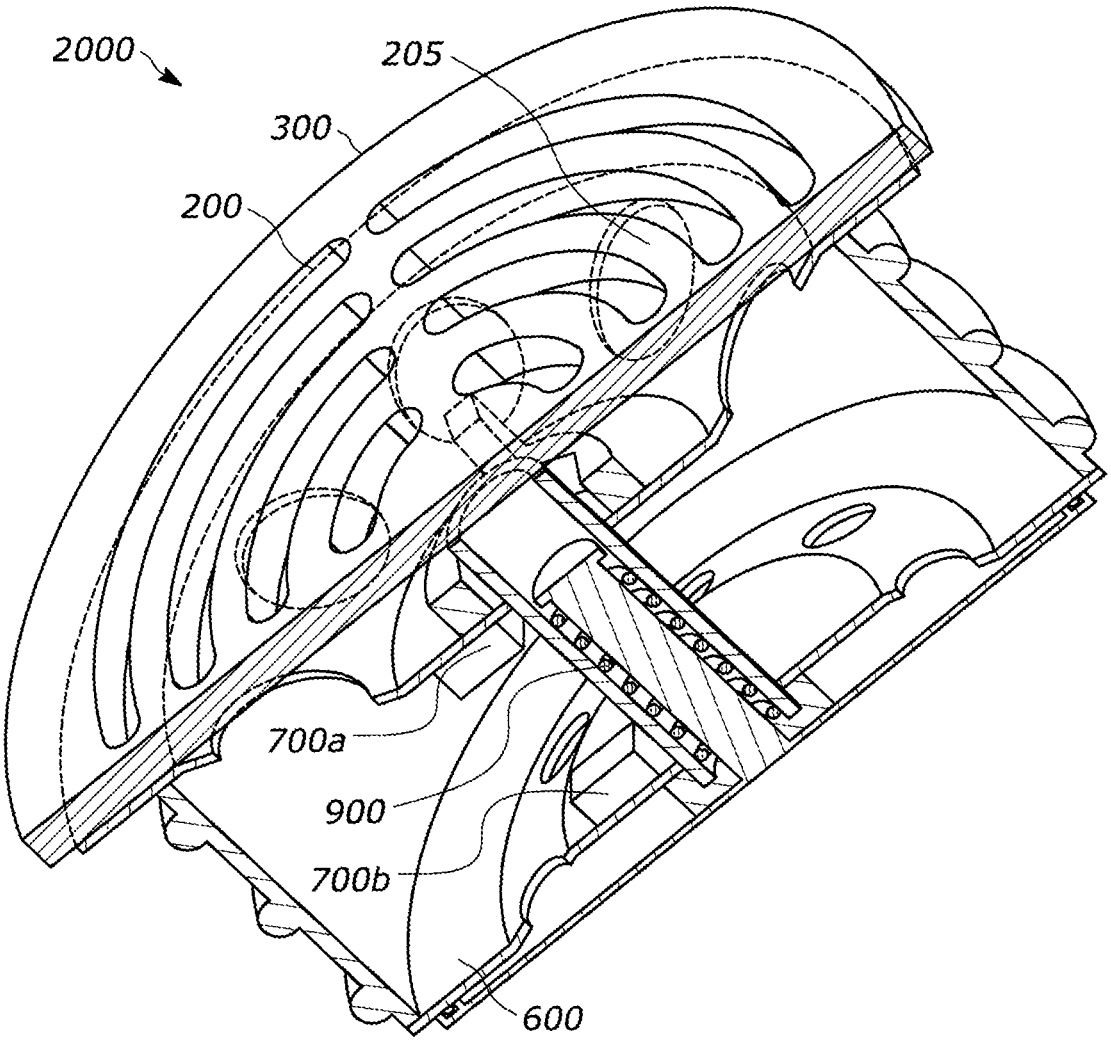
FIG. 8 shows a perspective view of a cross-section of an embodiment of a Waterless Floor Drain Trap Valve.

FIG. 6 shows an exploded view of the various elements (discussed in FIGS. 1-5) of an embodiment of a Waterless Floor Drain Trap Valve. FIG. 7 further illustrates the individual components of an embodiment of a Waterless Floor Drain Trap Valve. FIG. 8 shows a three-dimensional perspective view of a cross-section of an embodiment of a Waterless Floor Drain Trap Valve. As illustrated in FIGS. 6-8, a Waterless Floor Drain Trap Valve 2000 comprising an inlet end with a top cover 200 and an opposite outlet end with a bottom cover 600, a first sensor 700*a*, a second sensor 700*b*, an expandable outer seal 400 positioned between the top cover 200 and bottom cover 400, a conventional fastener (e.g., a nut) 100 positioned proximate to the top cover 200, a threaded rod 800, a backflow plate spring 900, a backflow preventer plate 1500 along with a backflow preventer seal 1300 is provided. The top cover 200 and bottom cover 600 further comprise a centrally located aperture and a plurality of apertures (205, 605) radially positioned and circumferentially dispersed at a predetermined distance from each other.

It is understood that the preceding is merely a detailed description of some examples and embodiments of the present invention, and that numerous changes to the disclosed embodiments may be made in accordance with the disclosure made herein without departing from the spirit or scope of the invention.

The preceding description, therefore, is not meant to limit the scope of the invention but to provide sufficient disclosure to allow one of ordinary skill in the art to practice the invention without undue burden. It is further understood that the scope of the present invention fully encompasses other embodiments that may become obvious to those skilled in the art, and that the scope of the present invention is accordingly limited by nothing other than the appended claims.

The invention claimed is:

1. A waterless floor drain trap valve comprising:

an inlet end configured with a top cover, the inlet end having a recessed opening and a grate to direct water flow, wherein an edge along a top surface of the grate is flushed with a top surface of the inlet end;

an opposite outlet end configured with a bottom cover;

a first sensor and a second sensor disposed within the valve and configured to deliver real-time monitoring of the valve;

wherein the first sensor is attached to the top cover and positioned in proximity to the inlet end and the second sensor is attached to the bottom cover and positioned in proximity to the outlet end;

an expandable outer seal positioned between the top and bottom cover;

a fastener positioned proximate to the top cover;

a threaded rod connected to a backflow preventer plate and a backflow plate spring and a backflow preventer seal in connection with the bottom cover;

wherein during operation the fastener is rotated and tightened by a certain predetermined amount over the top cover on the inlet end; and wherein the rotating and tightening of the fastener in proximity to the top cover further causes the bottom cover to travel a certain predetermined distance in an upward direction thereby outwardly expanding and compressing the outer seal against the inner surface of a drainpipe; and wherein the expansion and compression of the outer seal generates a plurality of seal points within the inside diameter of a floor drainpipe to provide optimum sealing of the drainpipe.

2. The valve of claim 1, wherein the first sensor is configured to sense the flow of water into the grate; and the second sensor is configured to receive information indicative of fluid, sewage and/or gases flowing in the reverse direction and thereby prevent backflow and escape of odors into the living area; and wherein the first and second sensors are further adapted and configured to connect remotely and wirelessly transmit data to various diagnostic devices, mobile platforms and applications for enhanced reliability and closed-loop feedback control of the valve.

3. The valve of claim 1, wherein the backflow preventer plate can be manufactured from steel or other materials having similar strength and tensile characteristics to withstand backflow pressure common in floor drains.

4. The valve of claim 1, wherein the valve can be further configured to act as a drain line backup to withstand pressure from water/sewage reversing direction and flowing into the occupied space of the building.

5. The valve of claim 1, wherein during the event of a drain line backup, the backflow preventer seal of the backflow preventer plate seals off and blocks the flow of sewage in the reverse direction.

6. The valve of claim 1, wherein the backflow preventer plate and the backflow preventer seal positioned in proximity to the bottom cover are configured to work cooperatively with each other and create a one-way valve allowing water to flow down the drain while preventing odors, harmful gases, pathogens or insects from entering the living space.

7. The valve of claim 1, wherein the tightening of the fastener allows the backflow plate spring to exert a light upward force on the backflow plate such that the backflow preventer seal needs only a small amount of pressure to function as a one-way valve; and wherein during a drain line backup event the backflow plate spring acts with sufficient force on the backflow preventer plate and keeps the plate in an upward sealed position.

8. The valve of claim 7, wherein the force of the spring is further balanced with the weight of the backflow preventer plate in order not to obstruct the passage of water in the normal flow direction.

9. The valve of claim 1, wherein elastic memory of the expandable outer seal urges the peripheral edge of the outer seal to extend horizontally and form a plurality of seal points against the inner surface of the drain.

10. The valve of claim 1, wherein the top and bottom cover further comprise a centrally located aperture and a plurality of apertures radially positioned and circumferentially dispersed at a predetermined distance from each other.

11. A method of using a waterless floor drain trap valve, the method comprising the steps of:

configuring an inlet end with a top cover, the inlet end having a recessed opening and a grate to direct water flow, wherein an edge along a top surface of the grate is flushed with a top surface of the inlet end;

configuring an opposite outlet end with a bottom cover;

configuring a first sensor and a second sensor within the valve to deliver real-time monitoring of the valve;

attaching the first sensor to the top cover and positioning the first sensor in proximity to the inlet end;

attaching a second sensor to the bottom cover and positioning the second sensor in proximity to the outlet end;

positioning an expandable outer seal between the top and bottom cover and a fastener proximate to the top cover;

connecting a threaded rod to a backflow preventer plate having a backflow plate spring;

rotating and tightening the fastener by a certain predetermined amount in proximity to the top cover on the inlet end and moving the bottom cover to travel a certain predetermined distance in an upward direction and thereby outwardly expanding and compressing the outer seal against the inner surface of a drainpipe;

forming a plurality of seal points within the inside diameter of a floor drainpipe to provide optimum sealing of the drainpipe.

12. The method of claim 11, wherein the first sensor is configured to sense the flow of water into the grate; and the second sensor is configured to receive information indicative of fluid, sewage and/or gases flowing in the reverse direction and thereby prevent backflow and escape of odors into the living area; and wherein the first and second sensors are further adapted and configured to connect remotely and wirelessly transmit data to various diagnostic devices, mobile platforms and applications for enhanced reliability and closed-loop feedback control of the valve.

13. The method of claim 11, wherein the backflow preventer plate can be manufactured from steel or other materials having similar strength and tensile characteristics to withstand backflow pressure common in floor drains.

14. The method of claim 11, wherein the valve can be further configured to act as a drain line backup to withstand pressure from water/sewage reversing direction and flowing into the occupied space of the building.

15. The method of claim 11, wherein during the event of a drain line backup, the backflow preventer seal of the backflow preventer plate seals off and blocks the flow of sewage in the reverse direction.

16. The method of claim 11, wherein the backflow preventer plate and the backflow preventer seal positioned in proximity to the bottom cover are configured to work cooperatively with each other and create a one-way valve allowing water to flow down the drain while preventing odors, harmful gases, pathogens or insects from entering the living space.

17. The method of claim 11, wherein the tightening of the fastener allows the backflow plate spring to exert a light upward force on the backflow plate such that the backflow preventer seal needs only a small amount of pressure to function as a one-way valve; and wherein during a drain line backup event the backflow plate spring acts with sufficient force on the backflow preventer plate and keeps the plate in an upward sealed position.

18. The method of claim 17, wherein the force of the spring is further balanced with the weight of the backflow preventer plate in order not to obstruct the passage of water in the normal flow direction.

19. The method of claim 11, wherein elastic memory of the expandable outer seal urges the peripheral edge of the outer seal to extend horizontally and form a plurality of seal points against the inner surface of the drain.

20. The method of claim 11, wherein the top and bottom cover further comprise a centrally located aperture and a plurality of apertures radially positioned and circumferentially dispersed at a predetermined distance from each other.

* * * * *